US008591356B2

(12) United States Patent
Walker

(10) Patent No.: US 8,591,356 B2
(45) Date of Patent: Nov. 26, 2013

(54) BASEBALL STRIKE ZONE DETECTION RADAR

(75) Inventor: William Walker, Los Gatos, CA (US)

(73) Assignee: Fujitsu Limited, Kawasaki-shi (JP)

( * ) Notice: Subject to any disclaimer, the term of this patent is extended or adjusted under 35 U.S.C. 154(b) by 181 days.

(21) Appl. No.: 12/964,441

(22) Filed: Dec. 9, 2010

(65) Prior Publication Data

US 2012/0146291 A1 Jun. 14, 2012

(51) Int. Cl.
*A63B 69/00* (2006.01)

(52) U.S. Cl.
USPC ..... 473/456; 473/454; 473/455

(58) Field of Classification Search
USPC ..... 473/454–456
See application file for complete search history.

(56) References Cited

U.S. PATENT DOCUMENTS 4,545,576 A 10/1985 Harris
5,138,322 A * 8/1992 Nuttall ..... 342/126
5,401,016 A 3/1995 Heglund et al.
5,509,649 A * 4/1996 Buhrkuhl ..... 473/455
5,676,607 A 10/1997 Stumpf
6,159,113 A 12/2000 Barber
6,358,164 B1 * 3/2002 Bracewell et al. ..... 473/454
6,985,206 B2 1/2006 Anderson et al.
7,270,616 B1 * 9/2007 Snyder ..... 473/453
2005/0197198 A1 * 9/2005 Otten et al. ..... 473/221
2009/0298622 A1 * 12/2009 Roberts ..... 473/455

* cited by examiner

*Primary Examiner* — Ronald Laneau
*Assistant Examiner* — Justin Myhr
(74) *Attorney, Agent, or Firm* — Baker Botts L.L.P.

(57) ABSTRACT

Systems and methods are provided for facilitating baseball strike zone detection. In accordance with one aspect of the present disclosure, a method includes transmitting radar pulses by a phased-array of transmitting antennas in a radar beam pattern, detecting reflected radar pulses of the transmitted radar pulses at multiple receiving antennas, calculating multiple positions of a projectile based on detecting the reflected radar pulses, determining whether an incursion through a three-dimensional strike zone characterized by batter-specific settings has occurred based on the multiple positions, and providing an indication of the incursion determination for presentation to a user.

21 Claims, 4 Drawing Sheets

BASEBALL STRIKE ZONE DETECTION RADAR

TECHNICAL FIELD

The present application relates generally to detection radars, and more specifically to baseball strike zone detection radars.

BACKGROUND

In the game of American baseball, it is well-known that human umpires frequently make errors in calling strikes and balls in baseball. Several strike-zone detectors have been proposed to eliminate human error. Many of these strike-zone detectors rely on optics to plot a baseball trajectory and are in use by television broadcasters to second-guess the umpire.

SUMMARY OF THE INVENTION

In accordance with the present disclosure, a baseball strike zone detector is provided which substantially eliminates or reduces disadvantages and problems associated with previous systems and methods.

In accordance with one aspect of the present disclosure, a method is provided for facilitating baseball strike zone detection. The method includes transmitting radar pulses by a phased-array of transmitting antennas in a radar beam pattern, detecting reflected radar pulses of the transmitted radar pulses at multiple receiving antennas, calculating multiple positions of a projectile based on detecting the reflected radar pulses, determining whether an incursion through a three-dimensional strike zone characterized by batter-specific settings has occurred based on the multiple positions, and providing an indication of the incursion determination for presentation to a user.

The present disclosure provides a number of technical advantages. For example, embodiments of the present disclosure may be designed to be cost effective for use at amateur baseball games. In some embodiments, for example, the baseball strike zone detector may employ a low-cost millimeter-wave radar integrated circuit comparable in complexity to an automotive radar and potentially in conjunction with relatively low-complexity software. The baseball strike zone detector of the present disclosure may also be more accurate and reliable than prior systems and methods. Many prior art systems, for example, require investments in expensive hardware, thereby rendering them economically impractical for amateur baseball games such as little league baseball games. Not surprisingly, the umpires in such amateur programs lack a high level of skill, which makes the cost-effective baseball strike zone detector of the present disclosure all the more useful.

In addition, the systems and methods discussed herein overcome the spurious output often generated by prior art systems due to clutter error. Clutter is most frequently created by a batter making a check swing. Any incursion of the batter or catcher into the strike zone can cause clutter error, resulting in a spurious output. Clutter is a common problem in laser and/or light-curtain based systems, as well as ultrasound-based systems. The design of the disclosed strike zone detector can help prevent clutter from affecting accurate strike zone detection.

Moreover, embodiments of the disclosed baseball strike zone detector may be quicker than prior systems because certain embodiments need not employ complex digital signal processing ("DSP") calculations to locate the baseball and track it. Prior art systems based on cameras often employ complex DSP software to find the baseball in the captured picture or video and track it, which usually demands large amounts of processing power and time for calculation. The computation time in such prior systems may be too large for effective use by an umpire since umpires typically must call a strike within a fraction of a second after the baseball crosses home plate. Therefore, those prior art systems are usually limited for use in television broadcasts of baseball games, where an umpire's error may be pointed out after several seconds have elapsed. The systems and methods of the disclosed baseball strike zone detector, however, may use simpler calculations to report a strike zone incursion faster than such prior art systems, which makes them particularly useful to umpires who must judge a strike almost immediately after a baseball pitch.

Furthermore, the system is noticeably less obtrusive than many prior systems because there is typically no visible hardware, light beams, or other structures that might affect the ambience of the baseball game. For example, prior art systems requiring hardware installation around the batting area and systems using light beams may impede visibility for spectators and/or players, interfere with the game, or have other aesthetic or logistic shortcomings. As discussed below, embodiments of the present disclosure allow the components to be embedded in home plate such that little or no obtrusiveness is introduced into the baseball game, or otherwise affect visibility or aesthetics associated with the game.

Other technical advantages of the present invention will be readily apparent to one skilled in the art from the following figures, descriptions, and claims. Moreover, while specific advantages have been enumerated above, various embodiments may include all, some, or none of the enumerated advantages.

BRIEF DESCRIPTION OF THE DRAWINGS

A better understanding of the present invention will be realized from the detailed description that follows, taken in conjunction with the accompanying drawings, in which.

DETAILED DESCRIPTION

Figure 1:
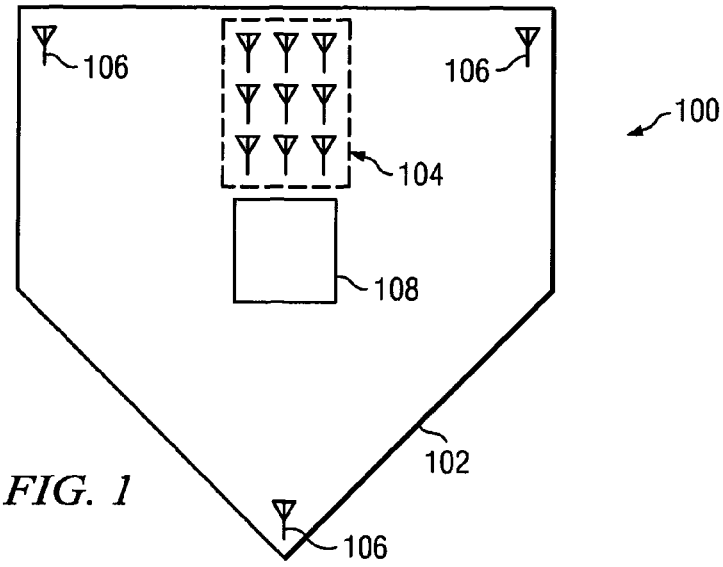
FIG. 1 is block diagram of the hardware configuration of an embodiment of a baseball strike zone detector according to the present disclosure.

FIG. 1 is a block diagram illustrating a system 100 with elements that work together to facilitate the determination of whether an projectile, such as a baseball, has passed through a predetermined space, such as a baseball strike zone. For example, the elements of system 100 can support a number of operations, including transmitting electromagnetic pulses at specified intervals to create a radar beam pattern, detecting the traversal of a projectile such as a baseball through the radar beam pattern, calculating the extrapolated trajectory of the projectile, and communicating an indication of whether the projectile traversed a predefined space, such as the strike zone corresponding to the batter. Although the embodiments of the present disclosure are discussed in terms of their application to baseball, the present disclosure envisions use of its teachings in any application where trajectories or movements of any object through one or more spaces might be determined.

The baseball strike zone is a fictitious three-dimensional pentagonal prism located directly above home plate that describes the space through which a baseball pitcher must pitch a baseball in order for the pitch to count as a strike when the baseball batter does not swing. The precise dimensions of the strike zone usually vary according to the baseball batter since it is usually defined in terms of the batter's physical characteristics, such as height. For example, Major League Baseball in 1996, defined the strike zone as that area over home plate the upper limit of which is a horizontal line at the midpoint between the top of the shoulders and the top of the uniform pants, and the lower level is a line at the bottom of the knees. The strike zone shall be determined from the batter's stance as the batter is prepared to swing at a pitched ball. Although the definition of the strike zone may vary depending on context, the strike zone is typically determined with respect to the physical characteristics of the baseball batter.

Baseball umpires can employ the functionality of system 100 to quickly and accurately determine whether a strike has occurred when a baseball batter chooses not to swing. In one embodiment, system 100 may be embedded in home plate. Embodiments such as system 100, may be manufactured to be small and affordable enough to be used in a wide variety of applications. For example, system 100 may be used in little league baseball games, intramural baseball, and other amateur baseball games. In some embodiments, system 100 may cause an strike zone indication (e.g. audio) to be presented to the umpire (e.g. via a headphone) to indicate whether a baseball has passed through the strike zone following a baseball pitch. In one embodiment, the strike zone indication may be presented by portable computer that acquires positional data concerning the baseball from system 100 and determines whether a strike zone incursion has occurred. Such a portable computer may be reset between pitches using a handheld device. In other embodiments, system 100 may include an embedded processor, thereby eliminating the need for an external computer to perform the strike zone detection computations. In such embodiments, a low-cost radio device such as a Bluetooth-enabled device (e.g. cell phone or a Bluetooth headset) could receive a strike zone indication from system 100 for presentation to the umpire. The Bluetooth-enabled device and/or portable computer may require an associated applet or other application to control other desired functions, such as calibration of system 100.

In the illustrated embodiment, system 100 includes a number of interconnected elements embedded in a home plate 102, including a transmit antenna array 104, receiving antennas 106, and a transceiver integrated circuit 108 to implement a fixed phased-array pulsed millimeter-wave radar.

Home plate 102 represents a typical baseball home plate and typically takes on a pentagonal shape. Home Plate 102 may serve as the structure within which several components of system 100 may be embedded. In particular embodiments, embedded radar components facilitate the determination of the baseball trajectory through a predefined space, such as a baseball strike zone. For example, embedded in home plate 102 are a number of elements such as transmit antenna array 104, receiving antennas 106, and transceiver integrated circuit 108. The existence of these additional elements allow home plate 102 to act in dual roles, that is, to serve as a traditional baseball home plate and additionally assist the umpire in determining whether a strike zone incursion has occurred. The various components of system 100 may be battery powered and accessed along with the battery (not shown) by unscrewing a plate coupled to home plate 102.

Transmit antenna array 104 represents a collection of antennas used to create a fixed radar beam projecting towards the pitcher's mound. In particular embodiments, the fixed radar beam projecting towards the pitcher's mound transmits minimal energy over home plate 102 to prevent or reduce clutter. A plastic coating transparent to the operational radio frequency may protect the antennas of transmitter array 104. The antennas of transmit antenna array 104 may be designed to beam the radar away from the plate in order to reduce clutter associated with a baseball batter entering or otherwise interfering with the strike zone. Employing such a radar beam pattern facilitates calculation of the trajectory of the ball while minimizing calculation errors due to clutter. Other embodiments, however, may or may not use such a radar beam pattern. In particular embodiments, the radar frequency is at least 60 to 66 GHz. Using a frequency in this range ensures that the wavelength is small enough to allow for about one centimeter accuracy. In addition, this frequency range has no added licensing requirements, thereby making embodiments such as system 100 useful for amateur baseball games. The radar frequency of the transmit antenna array 104, however, is not limited to the stated range. Embodiments of the present disclosure are not limited to low-frequency operation and higher frequencies may be used. In fact, using higher frequencies may have the advantageous effect of producing radar pulses that are less easily absorbed into the atmosphere and that are more accurate. Using such higher frequencies, however, may require licensing from the Federal Communications Commission ("FCC") or a similar licensing entity.

Receiving antennas 106 represent antennas spaced along the edge of home plate 102. Receiving antennas 106 are designed to detect position of a projectile, such as a baseball, as it approaches home plate 102 detect. For example, receiving antennas 106 may detect energy transmitted by transmit antenna array 104 and reflected off of an approaching baseball. As illustrated in system 100, receiving antennas 106 are spaced along three corners of the plate such that data received from them (e.g. counts) can be used to triangulate the position of the baseball as it approaches the front edge of home plate 102 or exits the radar beam created by transmit antenna array 104.

Transceiver integrated circuit 108 represents a processor having sufficient processing power to measure a set of positions of a baseball approaching home plate 102. Transceiver integrated circuit 108 can have low processing power because it does not need to not perform complex digital signal processing ("DSP") calculations to remove clutter created by the baseball batter entering the strike zone. Transceiver integrated circuit 108 may be coupled to one or more batteries to provide power for its operation. Such batteries also can be of low power in part due to the low processing power requirements of the transceiver integrated circuit 108. For example, in one embodiment, a trajectory of about one meter may be required to measure the set of positions (approximately, 10-15 positions depending on wavelength) necessary for detection of a strike zone incursion, which facilitates low power battery operation. In some embodiments, transceiver integrated circuit 108 may include a radio transceiver for sending positional data over a low-cost radio link, such as Bluetooth, to an external computer, such as a laptop computer or notebook personal computer which might be located in a backpack worn by the umpire. Such positional data may include a series of positions of the baseball tracking its trajectory as it approaches home plate 102. The external computer may in turn, compute an extrapolated trajectory of the baseball by extrapolating the received positional data and then determine whether the extrapolated trajectory of the baseball traversed the predefined strike zone using batter-specific settings. In other embodiments, components embedded in home plate 102 may perform all processing. For example, an on-board embedded processor or computer may perform the baseball trajectory and strike zone incursion calculations, and subsequently communicate a strike zone indication to umpire over a low-cost wireless link, such as Bluetooth, or a wired communication interface. In particular embodiments, system 100 may not communicate a strike zone indication to any particular individual, such as umpire, and instead generate an audio and/or visual indication of whether a strike zone incursion took place. For example, a sound, light and/or visual display may indicate to all interested individuals (e.g., umpires, players, and fans) whether a strike zone incursion has occurred.

In operation, elements of system 100 interoperate to determine whether a strike zone incursion has taken place by a projectile such as a baseball. In particular embodiments, transmit antenna array 104 may transmit a pulse every couple milliseconds to create a radar beam pattern. Such a pulsing frequency ensures that positional data for a typical 90 miles per hour baseball pitch, for example, may be captured every 4-8 centimeters. In operation, once the baseball pitcher pitches a baseball from the pitcher's mound towards home plate 102 and the ball enters the range of the beam pattern, transceiver integrated circuit 108 causes each of the receiving antennas 106 to begin capturing a series of counts associated with the position of the baseball from the perspective of each receiving antenna of receiving antennas 106. Next, the counts captured after every radar pulse by receiving antennas 106 may be communicated to the integrated circuit 108 to calculate and store a corresponding position of the baseball. In particular embodiments, these positional calculations may be performed by triangulating the position of the ball based on counts from multiple receiving antennas 106.

As the baseball approaches near the front edge of home plate 102, transceiver integrated circuit 108 instructs receiving antennas 106 to stop capturing positional data. Next, transceiver integrated circuit 108 transmits the stored positional data corresponding to each of the receiving antennas to a portable computer over a low cost radio link such as Bluetooth. The portable computer may, for example, be in a backpack worn by the umpire. The portable computer may then calculate the trajectory of the ball using the received positional measurements and compare the trajectory against a predefined strike zone defined according to batter-specific settings. From such a comparison, the portable computer can determine whether a strike zone incursion has occurred and deliver an appropriate strike zone indication to the umpire. In other embodiments, an on-board embedded processor or computer may perform the baseball trajectory and strike zone incursion calculations, and subsequently communicate a strike zone indication to umpire over a low-cost radio link or wired communication interface. For example, a strike zone indication may involve an audio, visual, or other multimedia being played or otherwise presented to the umpire to indicate whether a strike zone incursion has occurred.

While system 100 is illustrated as including specific components arranged in a particular configuration, it should be understood that various embodiments may operate using any suitable arrangement and collection of components capable of providing functionality such as that described. For example, home plate 102 may be embedded with the additional computing resources or circuitry necessary to determine whether a set of positional measurements captured at each of the receiving antennas 106 establishes a trajectory that traverses the predefined strike zone and provide an appropriate indication of whether a strike zone incursion took place.

Figure 2B:
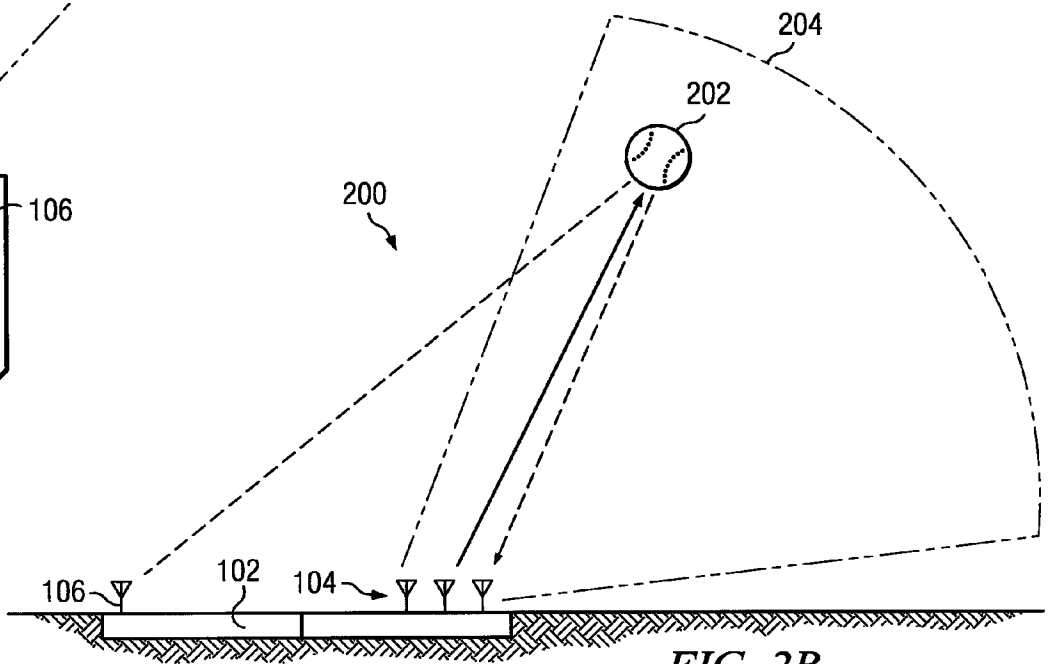
FIG. 2B is a block diagram of the side view of a radar beam pattern produced by an array of transmit antennas.
Figure 2A:
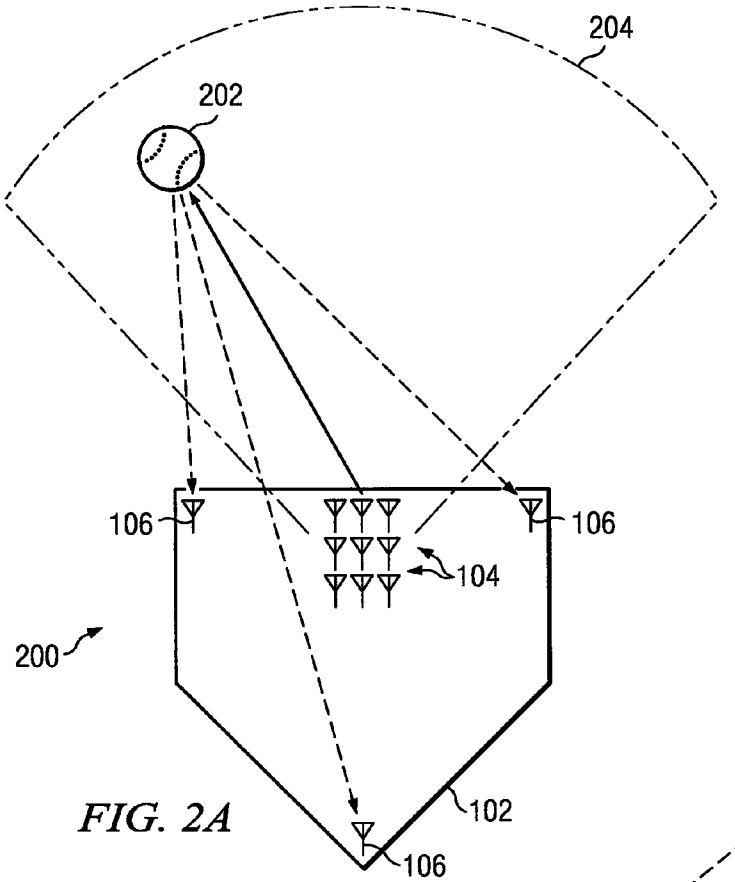
FIG. 2A is a block diagram of the top view of a radar beam pattern produced by an array of transmit antennas.

FIG. 2A is a block diagram illustrating the top view of a system 200 that demonstrates a radar beam pattern produced by an array of transmit antennas such as transmit antenna array 104. FIG. 2B provides a corresponding side view of system 200. As illustrated, the elements of system 200 may include elements analogous to those discussed above with respect to system 100 including home plate 102, transmit antenna array 104, and receiving antennas 106. In addition, system 200 illustrates a baseball 202 approaching home plate 102 through a radar beam pattern 204. System 200 shows the position of baseball 202 as it passes through the radar beam pattern 204 in two different views—a top view and a side view. As discussed above, the transmitting antenna array 104 transmits an electromagnetic pulse every couple of milliseconds in order to create the radar beam pattern 204. Once the baseball 202 enters radar beam pattern 204, receiving antennas 106 each begin capturing data (e.g. counts) corresponding to the location of baseball 202 in relation to each receiving antenna of receiving antennas 106. As baseball 202 approaches the front edge of home plate 102 or the baseball otherwise exits the beam pattern, data capture corresponding to the location of baseball 202 ceases. Thus, the position of baseball 202 may be calculated based on the captured data from each receiving antenna of receiving antennas 106 on the three corners of home plate 102. This calculation may involve triangulation to calculate the exact position of the baseball 202 in a Cartesian coordinate system. As discussed above, after a series of positional data has been collected, the positional data may be sent remotely to an external computer for calculation of an extrapolated trajectory and to determine whether the extrapolated trajectory of baseball 202 crossed the predefined strike zone defined by batter-specific settings. In other embodiments, these calculations and comparisons may be performed by additional circuitry embedded in home plate 102.

While system 200 is illustrated as including specific components arranged in a particular configuration, it should be understood that various embodiments may operate using any suitable arrangement and collection of components capable of providing functionality such as that described. For example, while system 200 is described in terms of baseball 202, the system may be used to calculate a series of positions and the trajectory of any projectile.

Figure 3:
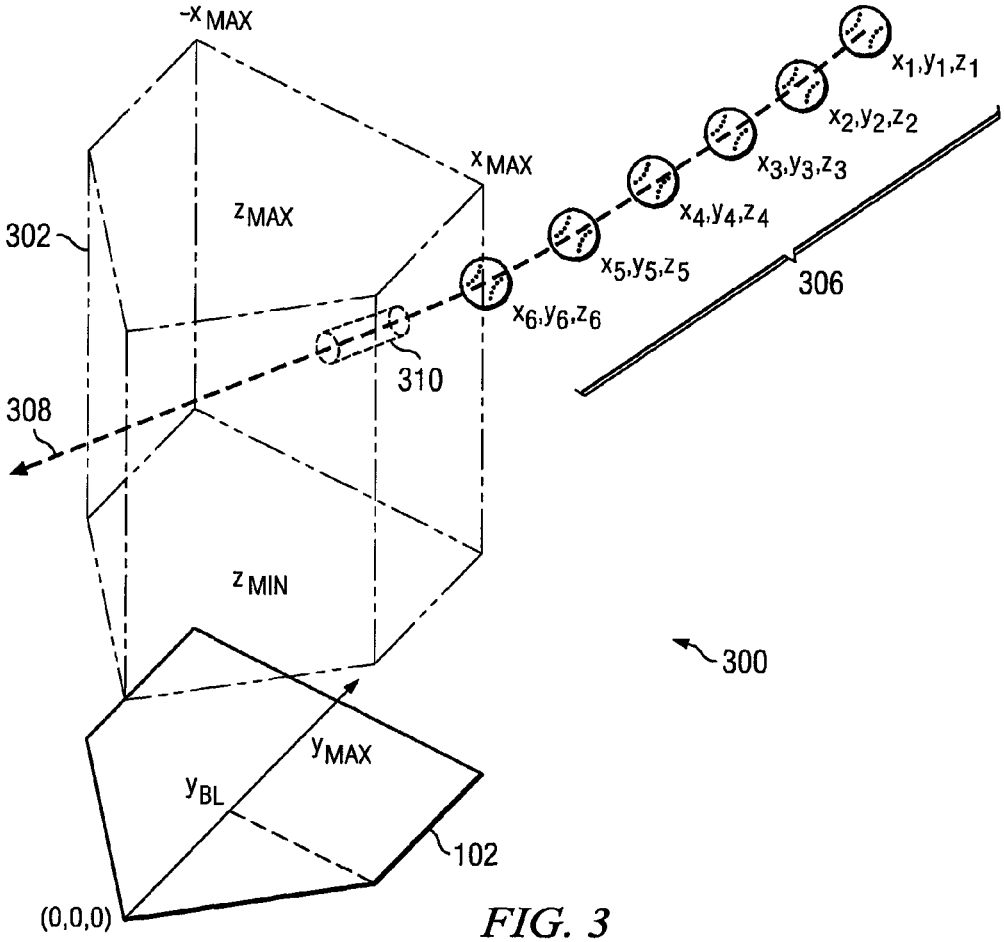
FIG. 3 is a block diagram illustrating a baseball trajectory calculation and detecting whether the baseball trajectory coincides with a predefined strike zone.

FIG. 3 is a block diagram illustrating a system 300 for performing a baseball trajectory calculation and detecting whether the baseball trajectory coincides with a predefined strike zone. As shown by system 300, a Cartesian coordinate system may be defined in terms of an object such as home plate 102. As illustrated, based on the position of home plate 102, the +y direction is towards the pitcher's mound, while the +z direction is towards the sky, and the x-axis is perpendicular to both the y and z axes. In the Cartesian coordinate system of system 300, coordinates (0, 0, 0) would be the bottom tip of home plate 102. System 300 also describes a strike zone 302 defined in terms in terms of the Cartesian coordinate system. For example, the strike zone may be completely specified by fixed coordinates $y_{b1}$, $y_{max}$, ±x-max, and by $z_{min}$ and $z_{max}$ which will vary for each baseball batter. To determine $z_{min}$ and $z_{max}$, each baseball player may be premeasured and their batter-specific settings entered into a database. Thus, in some embodiments, an umpire or other operator may enter an identification number for each baseball batter as he or she approaches home plate 102. The software on the external computer can look up $z_{min}$ and $z_{max}$ from the database. In other embodiments, an on-board embedded processor or computer may receive such batter-specific settings. In some embodiments, the system can be preloaded with a predetermined batting sequence of batters and the umpire or other operator may advance the sequence as each new baseball batter approaches home plate 102 for batting. By measuring each baseball batter in advance and maintaining those batter-specific settings, the baseball batter cannot manipulate their respective strike zone by, for example, squatting lower on a high pitch. Still in other embodiments, batter-specific settings may correspond to a class of batters such as standard size for third grade little league. Moreover, in some embodiments, batter-specific settings may correspond to small, medium, and large sizes for some group of baseball batters.

The measured positions 306 represent six measured positions captured by a baseball strike zone detection system such as system 100. Although only six measured positions are shown, a baseball strike zone detection system may require additional measured positions, such as 10-20 measured positions. The number of measured positions used in a particular embodiment may depend on wavelength or may be a specific length in front of home plate (e.g. 1 meter). The measured positions 306 may be used to establish an extrapolated trajectory 308 of the baseball as it passes over or near to home plate 102. Using the extrapolated trajectory 308, a strike zone incursion 310 into the strike zone 302 can be determined.

In operation, the extrapolated trajectory 308 of the baseball and incursion into the strike zone 302 may be calculated using a number of different methods that employ measured positions 306. For example, under the assumption that the trajectory takes on a straight-line, one method of calculation may use a least squares calculation to calculate a straight-line from the measured positions 306 $\{x_i, y_i, z_i=1 \ldots N\}$:

$$ax+by+cz+d=0$$

Using a least squares calculation, the coefficients a, b, c and d can be computed. Next, outlier positions such as positions exceeding one standard deviation from the mean distance of all points to the line can then be eliminated and a second iteration of the least squares method may be performed to develop a more accurate extrapolated trajectory. Moreover, the straight-line approximation may be verified algorithmically by fitting the measured points 306 to a higher degree polynomial. Using either a straight-line or a slightly higher degree polynomial has the advantage of keeping the number of computations relatively small, for example, on the order of 1,000 multiplies and adds. Therefore, a modern low-end portable computer operating at a clock frequency of 1 GHz, for example, can perform all the computations in approximately 10,000 clock cycles, or about 1 μsec. Once the extrapolated trajectory 308 is computed, detecting incursion into the strike zone 302 using the batter-specific settings involves a set of geometrical computations, which may take approximately 1,000 adds and multiplies, theoretically completing in approximately 1 μsec. In this manner, a strike zone incursion 310 can be determined where the extrapolated trajectory 308 coincides with the space defined by strike zone 302 corresponding to the batter. As shown in the figure, even a tangential incursion of the extrapolated trajectory 308 into the strike zone 302 may count be detected (and counted as a strike).

While system 300 describes a specific manner of performing a baseball trajectory calculation and detecting whether the baseball trajectory coincides with a predefined strike zone, other embodiments may employ more sophisticated trajectory calculations and detection techniques and still achieve near real-time operation.

Figure 4:
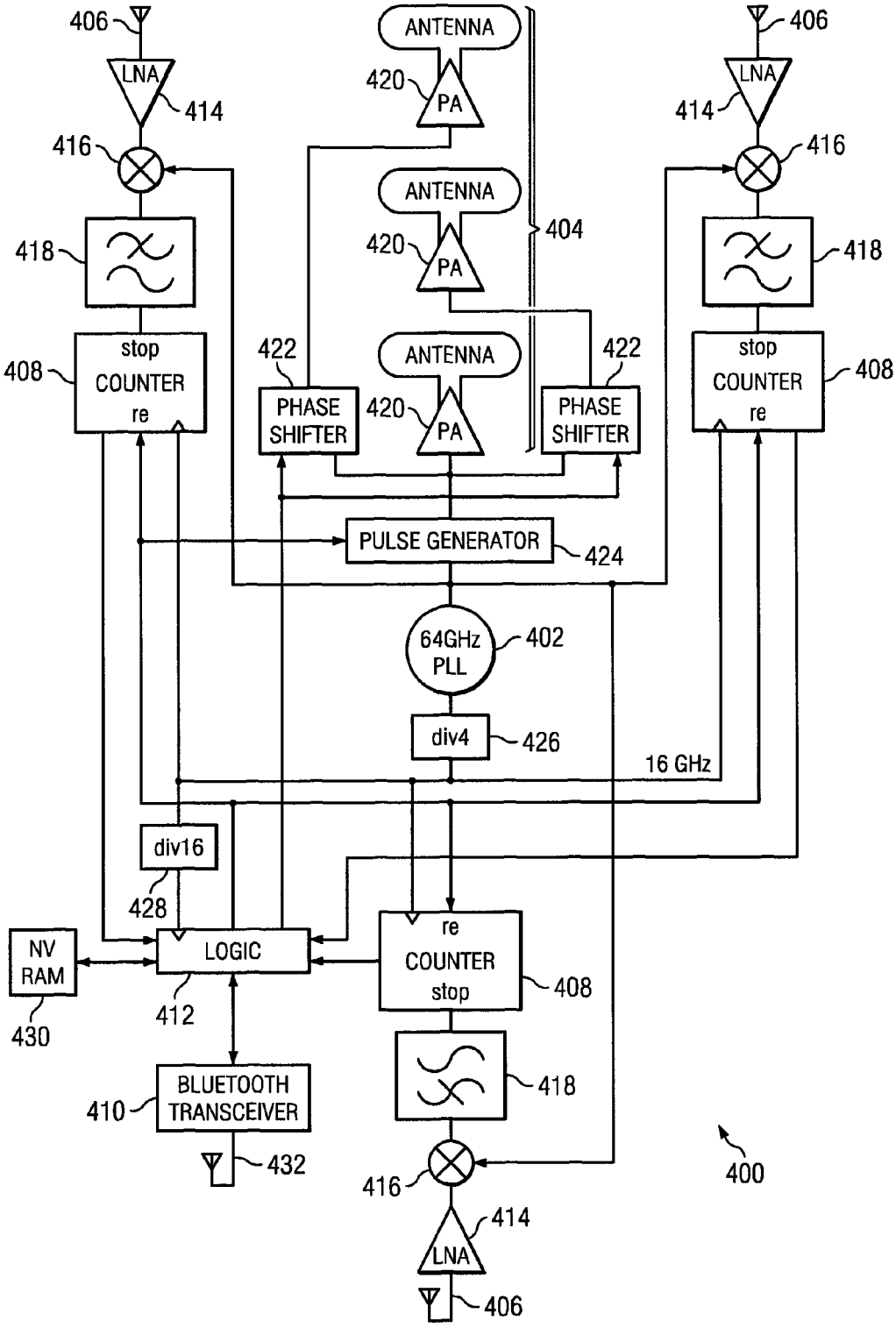
FIG. 4 is a block diagram illustrating a hardware architecture of a radar transceiver system that facilitates determination of whether a projectile, such as a baseball, has passed through a predetermined space, such as a baseball strike zone.

FIG. 4 is a block diagram illustrating a hardware architecture of a radar transceiver system 400 having elements that interoperate to facilitate the determination of whether a projectile, such as a baseball, has passed through a predetermined space, such as a baseball strike zone. The elements of system 400 can support a number of operations, including transmitting electromagnetic pulses at specified intervals to create a radar beam pattern, detecting the traversal of a projectile such as a baseball through the radar beam pattern, calculating the extrapolated trajectory of the projectile, and communicating an indication of whether the projectile traversed a predefined space such as the strike zone corresponding to the batter.

System 400 may be embedded in, for example, home plate 102 of system 100 to detect strike zone incursions for each of a series of baseball batters during a baseball game. The hardware architecture of system 400 can implement the high-level functionality described above with respect to system 100. For example, the hardware architecture of system 400 supports the transmission of radar beam pattern, capturing, at various receiving antennas, data corresponding to positions of a baseball as it approaches home plate, calculating a series of positions of the baseball based on the captured data, and the performance of additional operations as specified in appropriate logic. In one embodiment, such additional operations may include transmitting the positional data to a remote computer over a low-cost radio link or wired communication interface for calculation of the baseball trajectory, determination of a strike zone incursion using batter-specific settings, and communicating a strike zone indication to the umpire. In other embodiments, such additional operations may include performing on-board calculations of the baseball trajectory, determining a strike zone incursion using batter-specific settings, and communicating a strike zone indication to the umpire.

In the illustrated embodiment, system 400 includes a number of interconnected elements that are coupled to each other to perform strike zone incursion detection, including a clock 402, transmit antennas 404, receiving antennas 406, counters 408, Bluetooth transceiver 410, and logic block 412. System 400 may also include additional components to facilitate strike zone incursion detection, such as low-noise amplifiers ("LNAs") 414, mixers 416, low-pass filters 418, phased arrays 420, phase shifters 422, pulse generator 424, dividers 426 and 428, nonvolatile random access memory ("NV-RAM") 430, and wireless communication antenna 432.

In some embodiments, various components of system 400 may be consolidated on a single radio frequency integrated circuit ("RFIC") or complementary metal oxide semiconductor ("CMOS") application-specific integrated circuit ("ASIC"). For example, LNAs 414, mixers 416, low-pass filters and counters 408 may be located on a single RFIC. Similarly, the clock 402, pulse generator 424, dividers 426 and 428, and phase shifters 422 may reside on one RFIC. Likewise, the logic block 412, Bluetooth transceiver 410, and NV-RAM 430 may be located on a single CMOS ASIC. In addition, each phased array of phased arrays 420 may be located on a single RFIC and correspond to a single transmitting antenna of transmit antennas 404.

Clock 402 represents a local oscillator clock implemented by a phase-locked-loop ("PLL"). In certain embodiments, clock 402 may operate at a frequency above about 60 GHz. For example, operating at 64 GHz will enable system 400 to generate radar pulses that permit detection to an accuracy of about one centimeter. The clock 402 may be used to drive and synchronize the operation of various components of system 400. The output of clock 402 may be divided as necessary to run the various elements of system 400 using, for example, dividers 426 and 428. For example, the output of clock 402 may be divided by four to clock high-speed counters 408 at each of the receiving antennas 406. This division of the clock speed can facilitate the use of less expensive and low-power parts for counters 408. In addition, a further division by sixteen of the output of clock 402 may facilitate the operation of logic block 412, which performs a variety of functions associated with calculating the trajectory of a baseball through the strike zone corresponding to the baseball batter. Thus, if the clock operates at 64 GHz, this series of divisions result in a 1 GHz clock speed, which is common clock speed for a microprocessor. Although specific ratios are disclosed, other clock ratios are also possible depending on design considerations, selected components, and particular radar transceiver architectures.

Transmit antennas 404 represent a collection of antennas used to create a fixed radar beam projecting towards the pitcher's mound while, in certain embodiments, transmitting minimal energy over the elements of system 400. Although system 400 illustrates three transmit antennas 404, additional antennas may be used as appropriate in particular embodiments. For example, embodiments such as system 100 may use nine antennas. The use of multiple antennas facilitate beam formation using phased arrays, such as phased arrays 420. Phased arrays of antennas may be achieved by using one or more phase shifters, such as phase shifters 422. Each of the transmit antennas 404 operate together to form radar beam patterns such as the radar beam pattern described by system 200. As discussed above, the radar beam pattern produced by transmit antennas 404 using a phased array establishes the field within which positional data may be calculated as a baseball approaches system 400. For example, data capture begins at receiving antennas 406 when the baseball enters the radar beam pattern created by transmit antennas 404 and continues at substantially regular intervals until data capture ceases when the baseball nears the front edge of home plate. The shape of the radar beam pattern may be controlled as necessary by various phase shifters. Each phase shifter may be controlled by a code. According to particular embodiments, the code is static, and may be set at the factory and stored in a memory, such as NV-RAM 430. However, system 400 may use any suitable techniques, components, and parameters, whether static or dynamic, to generate an appropriate radar pattern. For example, although three transmitting antennas 404 are shown, a larger array employing additional antennas may be appropriate to achieve the desired radar beam shape.

Receiving antennas 406 represent antennas spaced apart from each other at different locations, such as three separate corners of a baseball home plate, for detecting reflected pulses corresponding to a projectile from three different perspectives. Receiving antennas 406 may be combined with other elements, such as LNAs 414, mixers 416, and low-pass filters 418 of system 400 to operate as a zero-intermediate frequency ("IF") receiver. Receiving antennas 406 may, for example, facilitate receiving, at various antenna locations, reflected radar pulses to determine a baseball's position within a fixed radar beam pattern generated by transmit antennas 404 and projected towards the pitcher's mound from home plate. In particular embodiments, data corresponding to each of the receiving antennas 406 is generated in the form of a series of counts and begins when the baseball enters the radar beam pattern and stops once the baseball nears the front edge of home plate. As shown, receiving antennas 406 are coupled to counters 408, which are responsible for generating the relevant counts corresponding to positions of the baseball.

Counters 408 represent counters associated with each of the receiving antennas 406. The counters 408 are synchronously reset and begin counting roughly at the operating frequency of the transmitting antennas 404, which in particular embodiments may be every couple of milliseconds. In certain embodiments, counters 408 themselves may operate at approximately 16 GHz, which allows the positional data derived from the counters to have a precision of a couple of centimeters. While other counters operating at higher frequencies may be used with system 400, they may have a complicated design and/or higher cost. Counters operating at lower frequencies may also be used, but such counters may suffer from a reduction in precision which can affect the accuracy of the strike zone detection. Each counter of counters 408 may stop when a reflected pulse is received. In particular embodiments counters 408 may be queried at a regular interval regardless of whether a reflected pulse is received. For example, counters 408 may be queried about every millisecond. In addition to the count value, the stop indicators of counters 408 may also be queried to determine whether the count value corresponds to reflected pulse. A reflected radar pulse may correspond to a radar pulse transmitted by transmitting antennas 404 being reflected off a projectile such as a baseball, and detected by each receiving antenna of receiving antennas 406. Such a reflected pulse may signal a successful detection of a projectile and the generation of a corresponding count value at each of the counters 408. In particular embodiments, when the stop indicator is queried and identified as not being set, system 400 may treat the condition as a timeout. For example, a timeout may represent a predefined time within which a reflected pulse off a projectile should have been sensed by each receiving antenna of receiving antennas 406 but was not. Thus, in certain embodiments, the count value may not correspond to a reflected pulse when the stop indicator is not set. Each count generated by counters 408 represents a measure of the roundtrip distance of a radar pulse from the transmitter off the baseball to the respective receiving antenna. Using the counts from each of the counters 408, the position of the baseball can be determined using appropriate logic. For example, when all counters 408 have stopped, the count values may be communicated to logic block 412 so that the position of the projectile can be calculated through known methods such as triangulation. On the next transmission cycle for transmission of the radar pulse by the transmitting antennas 404, counters 408 again may be reset to zero for generating counts for the next position of the projectile as it approaches closer to system 400. Thus, by repeating these steps at every transmission cycle, counters 408 can cause a series of positions corresponding to the trajectory of a projectile such as a baseball to be calculated and stored.

Bluetooth transceiver 410 represents a low-cost radio link, or other wireless or wired interface for communicating positional data to an external computing device for calculation or providing an indication of a strike zone incursion to a device for presentation to an umpire. Bluetooth transceiver 410 may operate according to any appropriate protocol such as the Bluetooth protocol. In particular embodiments, Bluetooth transceiver 410 may be coupled to wireless communications antenna 432 for transmitting information wirelessly to a remote device. For example, the use of a low-cost interface for communicating the information and calculations of system 400 ensures that the strike zone detector can be used in a wide variety of baseball applications including but not limited to amateur baseball. In particular embodiments, system 400 may not communicate a strike zone indication to any particular individual, such as umpire, and instead generate an audio and/or visual indication of whether a strike zone incursion took place. For example, a sound, light and/or visual display may indicate to all interested individuals (e.g., umpires, players, and fans) whether a strike zone incursion has occurred.

Logic block 412 represents suitable hardware and/or software components, controlling logic and data for controlling various operations of system 400 including receiving numerical data, such as counts from counters 408, and performing a number of additional operations. For example, in certain embodiments, logic block 412 may represent a processor such as an application-specific integrated circuit ("ASIC") capable of executing instructions or software. Some additional operations performed by logic block 412 may include calculating the position of a projectile using multiple counts each corresponding to a different receiving antenna. In one embodiment, additional operations may also include transmitting the positional data to a remote computer over a low-cost radio link such as a wireless link facilitated by Bluetooth transceiver 410 or a wired communication interface for calculation of an extrapolated projectile trajectory, determination of a strike zone incursion using batter-specific settings, and communicating a strike zone indication to the umpire. In other embodiments, additional operations may include performing on-board calculations of the extrapolated projectile trajectory, determining a strike zone incursion using batter-specific settings, and communicating a strike zone indication for presentation to the umpire.

In addition, logic block 412 may also set a phase shift code to control the radar beam shape produced by transmit antennas 404. Alternatively, the phase shift code may be static and, for example, set at the factory at the time of manufacture. However, logic block 412 may be employed to reprogram the phase shifters if, for example, drift is expected due to wear-and-tear during the operational lifetime of the radar transceiver.

Logic block 412 may also control a pulse generator to send a millimeter-wave pulse every couple of milliseconds. Simultaneously (or near simultaneously) with such a control signal, logic block 412 may reset counters 408 as necessary to generate counts associated with the position of a projectile. Logic block 412 queries each counter of counters 408 to collect count values that may correspond to a reflected pulse. As discussed above, if the stop indicator is not set, the count value may be meaningless because no reflected pulse was detected. This condition may be treated as a timeout. If, however, all counters 408 had stopped at the time counters 408 are queried, logic block 412 receives each of the counts and calculate the position of the projectile from these values. For example, logic block 412 may calculate and store a new position corresponding to the projectile after each radar pulse based on calculations (e.g. triangulation) performed on a set of collected counts. In addition, logic block 412 may determine when the projectile has left the radar beam pattern and subsequently initiate communication with an external computer to transmit positional data. For example, logic block 412 may detect a projectile leaving the beam after one to two successive time outs after a sequence of successful detections. In other embodiments, logic block 312 may also include an embedded processor or computer programmed to perform all the required computations to judge strike zone incursion, such as calculating the extrapolated trajectory of the projectile and determining incursion into a predefined space like a baseball strike zone.

In operation, elements of system 400 are synchronized to operate at a frequency corresponding to the frequency of clock 402 or some multiple or fraction of clock 402. Logic block 412, for example, may cause the transmission of a radar beam pattern from the phase array transmit antennas 404 every couple of milliseconds while simultaneously resetting the counters 408. Once a projectile enters the radar beam pattern, this event is detected by receiving antennas 406 and the counts are communicated to logic block 412 at the approximate frequency of the radar pulse transmission. Then, all counters 408 may be queried for their count and stop indicator values. If all stop indicators are set, logic block 412 calculates the position of the projectile based on counts retrieved from each of the counters 408. As mentioned, each of the counters 408 may be stopped when a reflected pulse is detected by the corresponding receiving antenna. Logic block 412 then reads the count of all three counters 408. Using the contents of counters 308, logic block 412 can calculate the position of the projectile using known methods such as triangulation. Thus, a new projectile position is calculated and stored after each pulse. If, however, logic 412 determines that the stop indicators are not set, the count values are meaningless (i.e. no reflected pulse was detected) and the condition is treated as a timeout. This repetitive process of retrieving multiple counts and calculating a projectile position continues until logic block 412 determines that the projectile has neared the front edge of system 400 (e.g. home plate) or has otherwise exited the radar beam pattern. In this manner, a set of positions corresponding to the trajectory of the projectile can be calculated and stored.

Once logic block 412 determines that the projectile has neared the front edge of system 400 or otherwise exited the radar beam pattern, logic 412 may initiate communication with an external computer, such a laptop or notebook personal computer, to transmit the collected positional data using, for example, Bluetooth transceiver 410 or other wireless or wired communication interface. As discussed above, the determination of whether a projectile has exited the radar beam pattern may be determined after detecting one to two successive timeouts after a sequence of successful detections. The external computer may then calculate the extrapolated trajectory of the projectile and subsequently use the extrapolated trajectory and the batter-specific settings to determine whether a strike zone incursion has occurred. Next, the external computer may communicate a strike zone indication to the umpire over a wired or wireless interface for presentation to the umpire. For example, a strike zone indication may involve an audio, visual, or other indication being played or otherwise presented to the umpire to indicate whether a strike zone incursion has occurred.

In some embodiments, logic block 412 may also include an embedded processor, logic, or computer programmed to perform all the required computations to judge strike zone incursion, such as calculating the extrapolated trajectory of the projectile and determining incursion into a predefined space like a baseball strike zone. In operation, such embodiments may perform an appropriate calculation, such as the least squares calculation discussed with respect to system 200, to extrapolate the trajectory of the projectile given the stored positions calculated from the series of counts retrieved from counters 408 of receiving antennas 406. Based on this extrapolated trajectory, logic block 412 may use the batter-specific settings and a number of geometric calculations to determine whether a strike zone incursion has occurred. Next, the logic block 412 may transmit a strike zone indication for presentation to the umpire over a wired or wireless interface such as Bluetooth transceiver 410.

Since the configuration of system 400 involves synchronized operation, calibration may be necessary to ensure accuracy and reliability of baseball strike zone detector. Typically there are two forms of calibration that might be needed to ensure radar accuracy. These include (1) phased shifter calibrations for controlling the radar beam pattern; and (2) positional calibration. Phase shifter calibration controls the beam pattern and normally may be performed at the factory at the time of manufacture. Small changes in the radar beam pattern will not typically impact accuracy of the radar. This type of calibration can be repeated in the field but would require RF test equipment such as an antenna connected to a power meter and a scaffolding.

The second type of calibration, positional calibration, may be necessary because of aging of the radio transceiver components of system 400 which may cause the position calculation to drift. In most situations, such positional drift may be minimized by using a proper design layout. For example, matching the wiring from the clock 402 to each counter and the wiring from logic block 412 to the reset pins of each counter can minimize drift in the position calculation. In particular embodiments, a star wiring configuration may be employed to provide the appropriate matching. However, aging of the individual components such as low noise amplifiers, mixers, and low pass filters may cause arrival times of the stop pulses at the counters 408 to drift over time, causing the count to drift. Fortunately, recalibration may be performed in the field using a calibration kit. An example calibration kit may consist of a non-reflective scaffold that attaches to home plate with a series of numbered perches. Calibration software supplied with the unit may facilitate moving a projectile, such as a baseball, from perch to perch and recalibrating the radar based on known coordinates of each perch. The resulting calibration may then be stored in NV-RAM, accessible by logic block 412.

While system 400 is illustrated as including specific elements arranged in a particular configuration, various embodiments may operate using any suitable arrangement and collection of elements to facilitate the determination of a traversal of a projectile through a predefined space.

Figure 5:
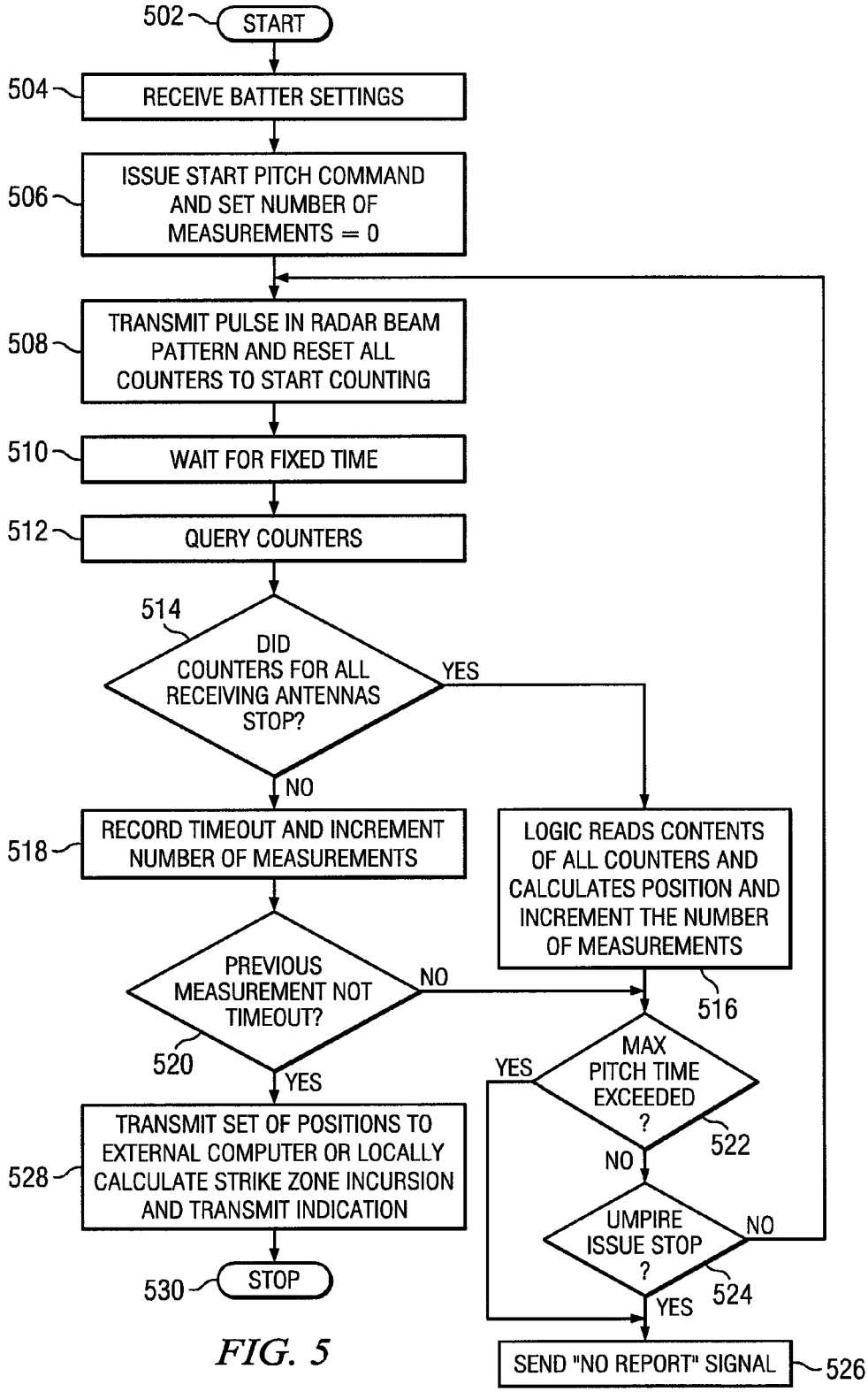
FIG. 5 is a process flowchart for capturing positional data for determining the trajectory of a baseball and detecting a strike zone incursion.

FIG. 5 is a flowchart of a process 500 for capturing positional data for determining the trajectory of a baseball and detecting a strike zone incursion. As illustrated, process 500 begins at step 502. At step 504, either on-board logic such as logic block 412 or an external computer receives batter-specific settings corresponding to a baseball batter that has approached home plate for batting. These batter-specific settings may include the $z_{min}$ and $z_{max}$ of the batter or a group of batters, and may be located in a database on local or external memory.

Next at step 506, an umpire or other user of the system may issue a start pitch command which resets the number of recorded measurements to zero. For example, an umpire may issue the start pitch command from a handheld device. Process 500 then proceeds to step 508, wherein the transmit antennas transmit a radar beam pattern and reset the counters corresponding to each of the receiving antennas. This synchronized transmission and resetting of the counters ensures that accurate counts are later generated at the receiving antennas. The counts generated by the counters at each of the receiving antennas represent a measure of the roundtrip distance of a radar pulse from the transmitter off the baseball to that receiving antenna. Using the counts from each of the counters, the position of the baseball can be calculated through known methods. At step 510, process 500 waits for a sufficient period of time to allow the transmitted radar pulses to travel to the baseball and return to the receiving antennas. In certain embodiments, this period of time may be about every millisecond. At step 512, the counters are queried both for their count and stop indicator values. Next, the system determines at step 514 whether all counters have stopped based on the stop indicator value. If all counters have stopped, then the count values are forwarded to a logic block to calculate a position in step 516. In addition, the number of measurements may also be incremented.

Next, process 500 proceeds to step 522 where the system determines whether the maximum pitch time has been exceeded. The maximum pitch time is a user-configurable time period that specifies the span of time within which the system can expect a baseball pitch. If the maximum pitch time has been exceeded, the system sends a signal indicating that no positions are reported at step 526, and process 500 ends at step 530. Otherwise, process 500 proceeds to step 524 where the system determines whether the umpire has issued a stop command using, for example, a handheld device. If the umpire issued a stop command, the system sends a signal indicating that no positions are reported at step 526, and process 500 ends at step 530. If the umpire did not issue a stop command, the system repeats the various steps of process 500 necessary to capture and calculate the next position of the baseball.

If, however, all the counters did not stop in step 514, the system recognizes that a timeout condition has occurred and increments the number of measurements at step 518. As discussed above, a timeout condition may occur when no reflected radar pulse is detected. Next, process 500 proceeds to step 520, where the system determines whether the previous positional data capture and calculation resulted in a timeout. If the last iteration did not result in a timeout, the process 500 performs steps 522 and 524 as described above.

If the last two positional data capture and calculations resulted in timeouts, at step 528, the set of positions captured for the pitched baseball may be transmitted to an external computer over a low-cost radio link or other wired or wireless interface. In one embodiment, this may involve transmitting the positional data wirelessly using a Bluetooth transceiver or other wireless or wired communication interface. The external computer receiving the positional data may be a portable computer such as a laptop or notebook personal computer. Once the positional data is received, the external computer would be operable to perform the baseball trajectory calculations using any number of methods (e.g. least squares calculation) to extrapolate the trajectory of the baseball, and detect whether the extrapolated trajectory impinges the strike zone associated with the batter using appropriate geometric calculations. As mentioned, the strike zone of the batter may vary according to the height of the batter and therefore, batter-specific settings may be preloaded into the system for determination of the appropriate strike zone attributable to the batter or a group of batters. Once the strike zone detection is made, the external computer can present a corresponding strike zone indication to the umpire. In other embodiments, calculations for extrapolating the trajectory of the baseball and determination of strike zone incursion may be performed locally using an embedded processor, computer, and/or logic. In such embodiments, the embedded processor and/or logic would be operable to transmit an appropriate strike zone indication to the umpire. Process 500 finishes then at step 530. Various steps of process 500 may be repeated as necessary for the next baseball pitch or the next baseball batter in the batting sequence.

While process 500 is illustrated as including specific steps performed in a particular manner, it should be understood that various embodiments may operate using any suitable arrangement and collection of steps capable of providing functionality such as that described.

Although the present disclosure describes several embodiments, it should be understood that a myriad of changes, substitutions, and alternations can be made without departing from the spirit and scope of the invention as defined by the appended claims.

What is claimed is:

1. A method comprising:

transmitting a plurality of radar pulses by a phased-array of transmitting antennas in a radar beam pattern;

detecting at each of a plurality of receiving antennas, reflected radar pulses of the transmitted radar pulses;

calculating, using a processor, a plurality of positions for each projection of a projectile based on detecting the reflected radar pulses;

determining whether an incursion through a three-dimensional strike zone has occurred based on the plurality of positions, wherein the three-dimensional strike zone is based on batter-specific settings; and providing an indication of the incursion determination for presentation to a user.

2. The method of claim 1, wherein calculating the plurality of positions for each projection of the projectile comprises, for each position of the projectile:

stopping one or more of a plurality of counters when a reflected radar pulse is detected, each of the plurality of counters associated with one of the plurality of receiving antennas and the counters having a corresponding counter value;

determining whether at least three of the plurality of counters have stopped; and calculating a position of the projectile based on the counter values of at least three stopped counters.

3. The method of claim 2, wherein calculating the position of the projectile comprises triangulating the position using the counter values, wherein each of the counter values corresponds to a time taken for one of the transmitted radar pulses to travel to the projectile and be detected as one of the reflected pulses at the receiving antenna associated with the counter.

4. The method of claim 1, wherein determining whether the incursion through the three-dimensional strike zone has occurred based on the plurality of positions, wherein the three-dimensional strike zone is based on batter-specific settings, comprises:

detecting at least one timeout after a series of successful detections;

extrapolating a trajectory of the projectile based on the plurality of positions;

using the batter-specific settings to determine a three-dimensional strike zone; and determining whether the extrapolated trajectory traverses the three-dimensional strike zone.

5. The method of claim 4, wherein extrapolating the trajectory comprises performing a least-squares calculation using the plurality of positions.

6. The method of claim 1, wherein providing the indication of the incursion determination for presentation comprises communicating the incursion indication to a remote device.

7. The method of claim 1, wherein the incursion determination is presented to the user as a message, the message having one or more of the following message types: text, audio, or video.

8. An apparatus comprising:

a phased-array of transmitting antennas configured to transmit a radar beam pattern;

a plurality of receiving antennas positioned apart from each other at different locations, each receiving antenna comprising a mixer;

a pulse generator having an output coupled to the phased-array of transmitting antennas and coupled to the mixers of the receiving antennas;

a plurality of counters, each counter corresponding to one of the plurality of receiving antennas, each counter comprising a reset input and a stop counter input, the reset input coupled to the pulse generator and the stop counter input coupled to the mixer of the corresponding one of the receiving antennas; and a processor operable to:

receive a plurality of counter values from the counters after at least three of the plurality of counters have stopped;

calculate a plurality of positions for each projection of the projectile based on the counter values;

determine whether an incursion through a three-dimensional strike zone has occurred based on two or more positions, wherein the three-dimensional strike zone is based on batter-specific settings; and provide an indication of the incursion determination for presentation to a user.

9. The apparatus of claim 8, wherein the processor is further operable to calculate the position of the projectile by triangulating the position using the counter values, wherein each of the counter values corresponds to a time taken for a transmitted radar pulse to travel to the projectile and be detected as a reflected pulse at the receiving antenna corresponding to the counter.

10. The apparatus of claim 8, wherein the processor is further operable to determine whether the incursion through the three-dimensional strike zone has occurred based on the one or more positions, wherein the three-dimensional strike zone is based on batter-specific settings, by:

detecting at least one timeout after a series of successful detections;

extrapolating a trajectory of the projectile based on the two or more positions;

using the batter-specific settings to determine a three-dimensional strike zone; and determining whether the extrapolated trajectory traverses the three-dimensional strike zone.

11. The apparatus of claim 10, wherein the processor is further operable to extrapolate the trajectory by performing a least-squares calculation using the two or more positions.

12. The apparatus of claim 8, wherein the processor is further operable to provide the indication of the incursion determination for presentation by communicating the incursion indication to a remote device.

13. The apparatus of claim 8, wherein the processor is further operable to present the incursion determination to the user as a message, the message having one or more of the following message types: text, audio, or video.

14. The apparatus of claim 8, further comprising a transceiver coupled to the processor for communicating at least one of the one or more positions or the incursion determination to a remote device.

15. An apparatus comprising:

means for transmitting a plurality of radar pulses by a phased-array of transmitting antennas in a radar beam pattern;

means for detecting at each of a plurality of receiving antennas, reflected radar pulses of the transmitted radar pulses;

means for calculating a plurality of positions for each projection of a projectile based on detecting the reflected radar pulses;

means for determining whether an incursion through a three-dimensional strike zone has occurred based on the plurality of positions, wherein the three-dimensional strike zone is based on batter-specific settings; and means for providing an indication of the incursion determination for presentation to a user.

16. The apparatus of claim 15, wherein the means for calculating the plurality of positions for each projection of the projectile comprises, for each position of the projectile:

means for stopping one or more of a plurality of counters when a reflected radar pulse is detected, each of the plurality of counters associated with one of the plurality of receiving antennas and the counters having a corresponding counter value;

means for determining whether at least three of the plurality of counters have stopped; and means for calculating a position of the projectile based on the counter values of at least three stopped counters.

17. The apparatus of claim 16, wherein the means for calculating the position of the projectile comprises means for triangulating the position using the counter values, wherein each of the counter values corresponds to a time taken for one of the transmitted radar pulses to travel to the projectile and be detected as one of the reflected pulses at the receiving antenna associated with the counter.

18. The apparatus of claim 15, wherein the means for determining whether the incursion through the three-dimensional strike zone has occurred based on the plurality of positions, wherein the three-dimensional strike zone is based on batter-specific settings, comprises:

means for detecting at least one timeout after a series of successful detections;

means for extrapolating a trajectory of the projectile based on the plurality of positions;

means for using the batter-specific settings to determine a three-dimensional strike zone; and means for determining whether the extrapolated trajectory traverses the three-dimensional strike zone.

19. The apparatus of claim 18, wherein the means for extrapolating the trajectory comprises means for performing a least-squares calculation using the plurality of positions.

20. The apparatus of claim 15, wherein the means for providing the indication of the incursion determination for presentation comprises means for communicating the incursion indication to a remote device.

21. The apparatus of claim 15, wherein the incursion determination is presented to the user as a message, the message having one or more of the following message types: text, audio, or video.

* * * * *